United States Patent [19]

Clark

[11] 4,265,587

[45] May 5, 1981

[54] QUICK-COUPLING LOCKING MECHANISM

[75] Inventor: James W. Clark, Gladstone, Mich.

[73] Assignee: Envirotech Corporation, Menlo Park, Calif.

[21] Appl. No.: 60,267

[22] Filed: Jul. 25, 1979

[51] Int. Cl.[3] ..... E02F 3/81

[52] U.S. Cl. ..... 414/723; 74/520; 172/273

[58] Field of Search ..... 414/723, 722, 686; 37/117.5, 41; 172/272, 273, 274, 275; 74/520, 106, 100 R; 403/24, 25; 280/479 R

[56] References Cited

U.S. PATENT DOCUMENTS

| | | | |
|---|---|---|---|
| 3,818,551 | 6/1974 | Coughran | 414/723 X |
| 3,935,953 | 2/1976 | Stedman | 414/723 X |
| 4,013,182 | 7/1977 | Pratt et al. | 414/723 X |
| 4,068,959 | 1/1978 | Pemberton | 172/273 X |
| 4,116,346 | 9/1978 | Uchida | 414/723 |
| 4,116,347 | 9/1978 | Uchida | 414/723 |
| 4,204,794 | 5/1980 | Aoshiba | 414/723 |

FOREIGN PATENT DOCUMENTS

| | | | |
|---|---|---|---|
| 814808 | 6/1969 | Canada | 172/273 |

*Primary Examiner*—Robert J. Spar
*Assistant Examiner*—Jerold M. Forsberg
*Attorney, Agent, or Firm*—Robert E. Krebs; Thomas S. MacDonald

[57] ABSTRACT

A quick-coupling locking mechanism is provided comprising a C-shaped attachment means (2) which is secured to a service module (C) of any type and a toggle linkage assembly which is secured to a service vehicle (B). The C-shaped attachment means (2) is formed to define a lifting hook (3) at its top and a holding hook (4) at its bottom. The linkage assembly includes a horizontal lifting bar (5) for engagement with the lifting hook (3) and a horizontal holding bar (6) for engagement with the holding hook (4). The linkage assembly is selectively operable to move the lifting bar (5) into secure engagement with the lifting hook (3) to raise the service module (C) such that the holding hook (4) is brought into engagement with the holding bar (6). The linkage assembly further includes separating means (21) responsive to the movement of the assembly to force the lifting bar (5) away from the holding bar (6) to lock the lifting bar (5) and the holding bar (6) into secure engagement with the attachment means (2).

5 Claims, 6 Drawing Figures

QUICK-COUPLING LOCKING MECHANISM

BACKGROUND OF THE INVENTION

1. Field of the Invention

The present invention relates generally to an apparatus for attaching an implement to a vehicle and particularly to an automatic quick-coupling locking mechanism for attaching a service module to a mining service vehicle.

2. State of the Art

Especially in the underground mining industry, the logistics of delivering supplies and dispatching service vehicles of all types has been one of the most costly and complex aspects of operation. Typically a large number and wide variety of specialty vehicles are utilized to perform the different mine service requirements. For example, different types of vehicles are utilized to haul pipe or timber, to transport mine personnel and to move heavy loads. The result is the expenditure of vast sums of money for both capital equipment and operating costs.

Past efforts to minimize such expenditures have included attempts to provide a standardized service vehicle which can automatically connect to and disconnect from a variety of service implements. Usually such vehicles have included a boom assembly which is mounted at the front end of the vehicle and includes a number of hydraulic cylinders for tilting and lifting the boom. Such boom assemblies typically utilize a hydraulic hitching mechanism which includes reciprocal sliding pins which when activated engage the implement and connect it to the vehicle. A sliding-pin hitch assembly of this type is taught by U.S. Pat. No. 3,760,883.

Sliding-pin hitch assemblies have a number of significant deficiencies. A major disadvantage of such assemblies is that extremely accurate alignment of the sliding pins and the receiving slots of the implement is required for proper operation of the connecting mechanism. Frequently, because the pins are the load-carrying member of the hitch assembly and because the vehicles are exposed to heavy duty service, either the pins or receiving slots of the implement become bent or damaged. Thus, manual engagement of the hitch assembly and the implement is often required, causing substantial inconvenience and loss of time, to say nothing of the safety hazards presented by such practices. The need for proper alignment of the hitch assembly and the service implement further requires that both the service vehicle and implement be located on smooth terrain. Rough terrain prevents proper alignment. Another disadvantage of sliding-pin assemblies is that the load of the service implement is carried indirectly by the hydraulic system utilized to activate the pins. Thus, a failure of the hydraulic system results in the disengagement of the implement.

In another type of hitch assembly, a pair of horizontal bars attached to a hydraulically operated lifting boom are brought into contact with a bracket attached to an implement. A hydraulic cylinder mounted generally vertically between the two horizontal hitching bars operates to force the bars apart from one another and into engagement with a pair of receiving mounts formed as part of the bracket. Hitching assemblies of this type are also dependent on a hydraulic system for secure attachment of the implement to the vehicle. A leak or failure in the hydraulic system causes the hitch assembly to become inoperative and could result in serious accident or injury. This type of system also requires a lifting boom which carries the load of the implement at a distance from the front axle of the vehicle. This presents a counterbalancing problem for low machines of the type required for underground mining.

OBJECTS OF THE INVENTION

An object and advantage of the present invention is the provision of an automatic quick-coupling locking mechanism for attaching a service module to a mining service vehicle.

A further object and advantage of the present invention is the provision of a mining service vehicle having a standardized quick-coupling locking mechanism for attaching an unlimited variety of service modules to the service vehicle.

A further object and advantage of the present invention is the provision of an automatic quick-coupling locking mechanism for attaching a service module to a mining service vehicle even though the module and the vehicle may be askew.

A further object and advantage of the present invention is the provision of an automatic quick-coupling locking mechanism for securely attaching a service module to a mining service vehicle even in the event of hydraulic failure in the mechanism.

A still further object and advantage of the present invention is the provision of an automatic quick-coupling locking mechanism which lifts and locks a service module to a mining service vehicle in a fixed carry position in one actuation such that the load of the service module is carried relatively close to the front axle of the service vehicle.

BRIEF DESCRIPTION OF THE DRAWINGS

These and other objects and advantages of the present invention will become better understood by reference to the following detailed description of the preferred embodiment and accompanying drawings in which like reference numerals designate like parts throughout the Figures thereof and wherein.

DETAILED DESCRIPTION OF THE PREFERRED EMBODIMENT

Figure 1:
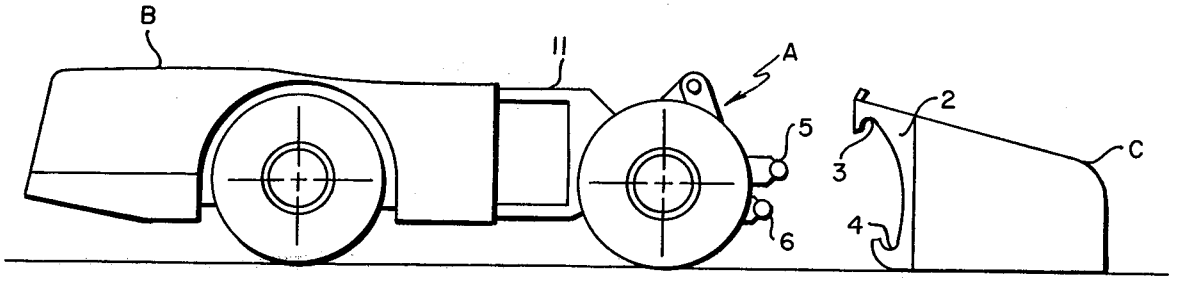
FIG. 1 is a side view of a mining service vehicle, service module and locking mechanism showing the approach of the service vehicle to the service module.
Figure 2:
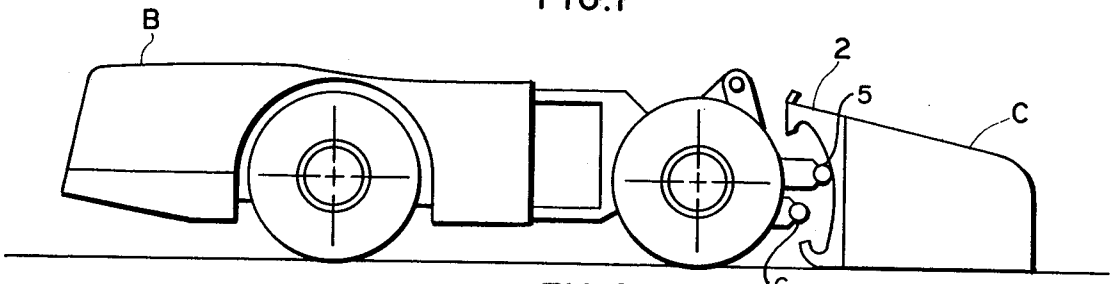
FIG. 2 is a side view of a mining service vehicle, service module and locking mechanism showing contact between the lifting bar 5 and the attachment means 2.
Figure 3:
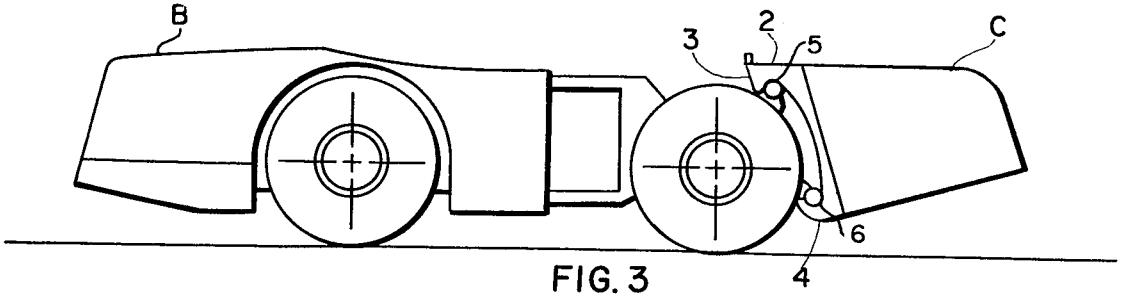
FIG. 3 is a side view of a mining service vehicle, service module and locking mechanism showing the secure engagement of the lifting bar 5 and the holding bar 6 with the lifting hook 3 and the holding hook 4, respectively.

As shown in FIGS. 1–3, the automatic quick-coupling locking mechanism of the present invention generally comprises a linkage assembly A rigidly secured to a service vehicle B, preferably a mining service vehicle, and a generally C-shaped attachment means 2 rigidly secured to a service module C. While the service module C is illustrated as a load-carrying implement, it should be understood that the module can be any type of tool or service device.

The C-shaped attachment means 2 is formed to define a downwardly concave lifting hook 3 at its top and an upwardly concave holding hook 4 at its bottom. In the illustrated embodiment, the attachment means comprises two brackets 2 (shown in hidden lines in FIG. 6) mounted at the rear end of the service module C to extend outwardly therefrom. Each of the brackets 2 is formed to define a lifting hook 3 at its top and a holding hook 4 at its bottom. The attachment means 2 may be secured to the service module C by bolts, welds or other suitable means or may be formed as an integral part of the service module. Further, while in the illustrated embodiment, a plurality of brackets are shown, it should be understood that the attachment means 2 could be a single member extending horizontally across the rear end of the service module C and having lifting and holding hooks formed over all or a part of its width.

The linkage assembly A, which is described in detail hereinbelow, includes a horizontal lifting bar 5 for engagement with the lifting hook 3 and a horizontal holding bar 6 for engagement with the holding hook 4.

FIGS. 1–3 illustrate generally the operation of the locking mechanism of the present invention. FIG. 1 shows the service vehicle B approaching the service module C. FIG. 2 shows the lifting bar 5 making contact with the attachment means 2 at a point between the lifting hook 3 and the holding hook 4. After contact is established between the lifting bar 5 and the attachment means 2, the linkage assembly A is activated as described in detail hereinbelow to move the lifting bar 5 generally upwardly into secure engagement with the lifting hook 3. Further upward movement of the lifting bar 5 after its engagement with the lifting hook 3 causes the service module C to be lifted at its rear end in a generally pivotal movement about the lower front end of the service module C and to be drawn toward the service vehicle B until the attachment means 2 makes contact with the holding bar 6. Still further upward movement of the lifting bar 5 raises the service module C until holding hook 4 achieves engagement with the holding bar 6. Then, as described in detail below, further movement of lifting bar 5 causes service module C to be securely locked to vehicle B in a fixed, relative carry position shown in FIG. 3.

Figure 4:
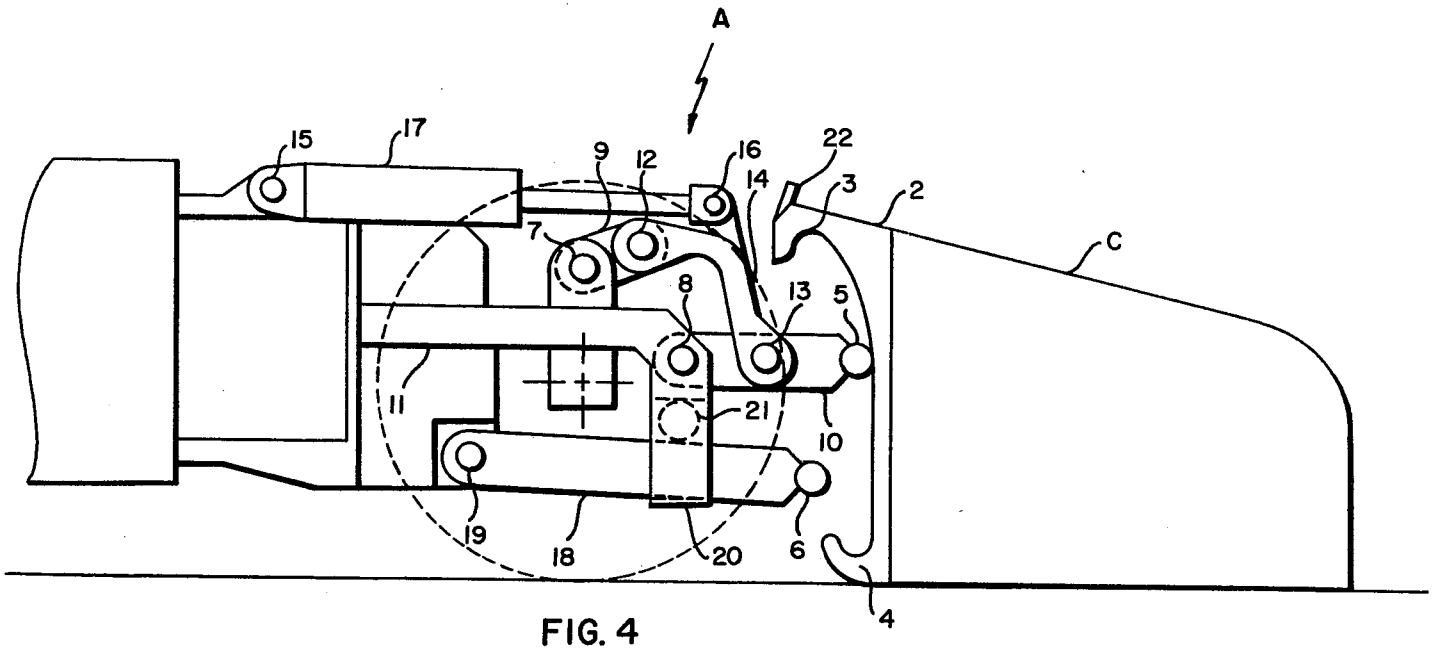
FIG. 4 is a side view showing a detailed arrangement of the locking mechanism in the disengaged position.
Figure 5:
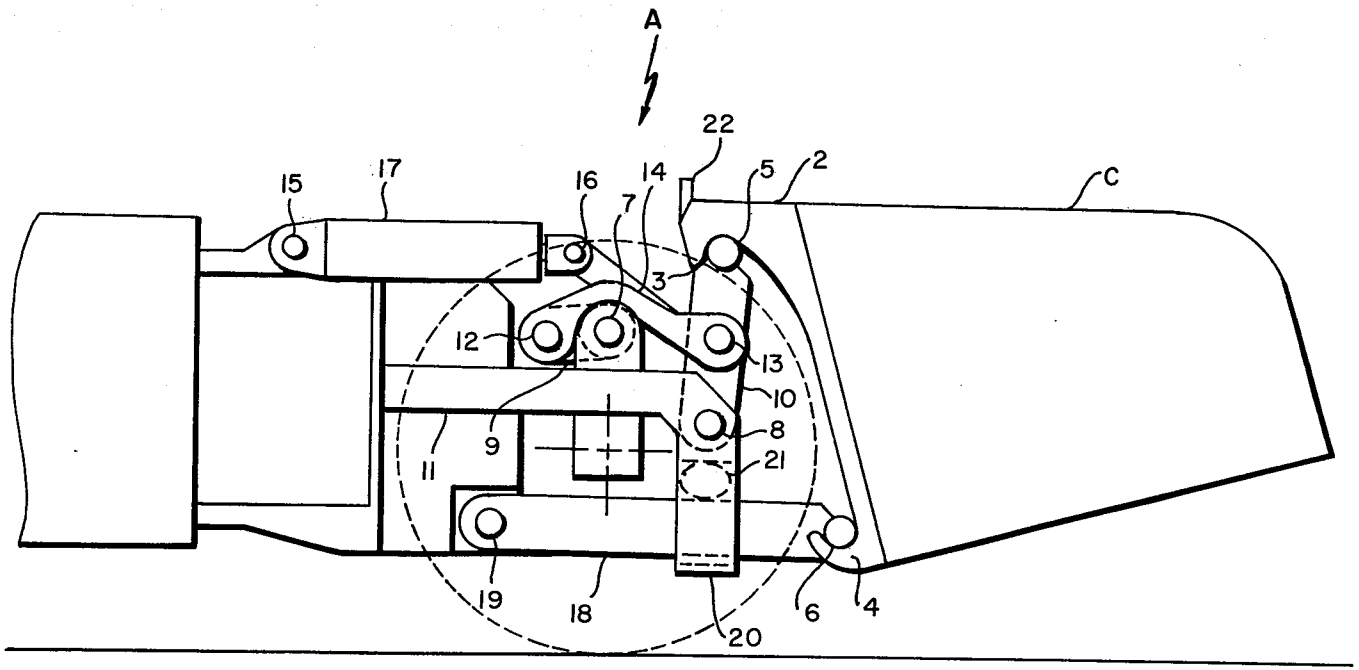
FIG. 5 is a side view showing a detailed arrangement of the locking mechanism in the engaged position.
Figure 6:
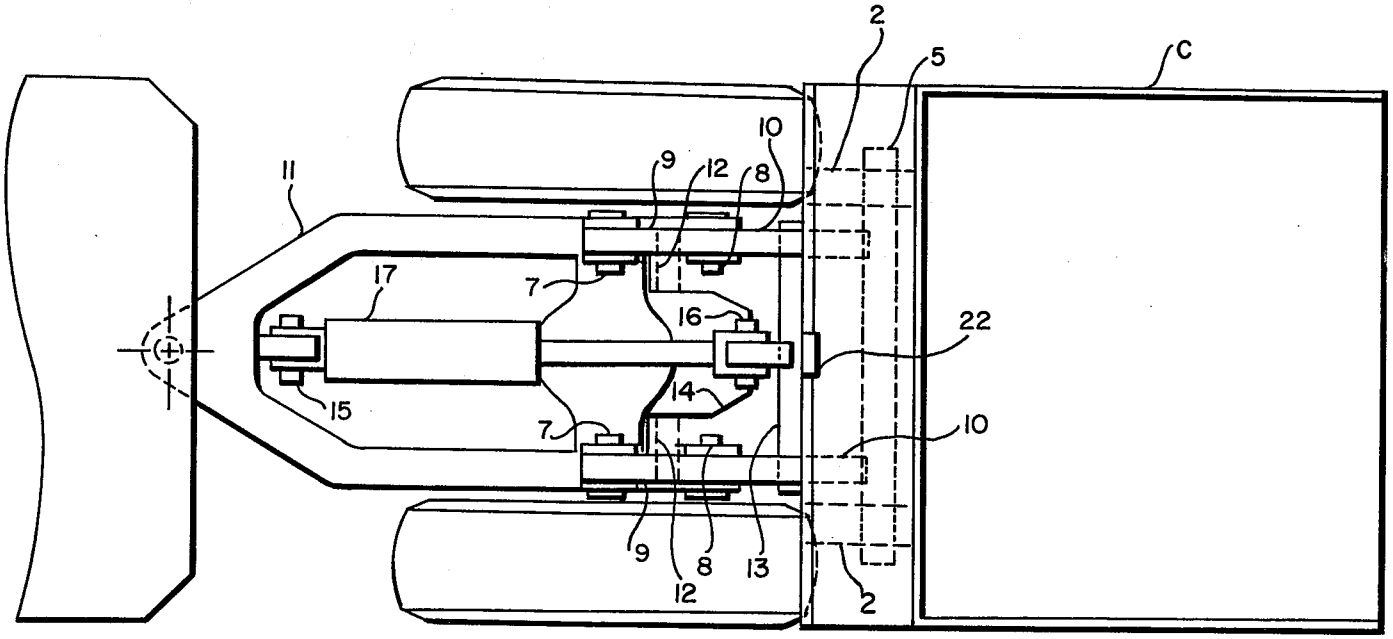
FIG. 6 is a plan view showing the locking mechanism in the engaged position.

FIGS. 4–6 show the linkage assembly A in detail. A toggle link 9 and a lifting bar link 10 are pivotally connected to a extension 11 of the frame of the service vehicle by pivot pins 7 and 8, respectively. A connecting link 14 is connected to the toggle link 9 and the lifting bar link 10 by pivot pins 12 and 13, respectively, to form a lockable toggle linkage. Horizontal lifting bar 5 is mounted at the distal end of the lifting bar link 10. In the illustrated embodiment, a selectively extensible reciprocal actuator means 17, illustrated as a hydraulic cylinder, is connected to the frame extension 11 and the connecting link 14 by pivot pins 15 and 16, respectively. Thus, actuator means 17 is selectively operable to forceably move the toggle linkage comprising links 9 and 14 from the open position shown in FIG. 4 to the locked position shown in FIG. 5 and vice versa.

A holding bar link 18 having horizontal holding bar 6 mounted at its distal end is pivotally attached to the frame extension 11 by pin 19. The holding bar link 18 is restrained and guided by a stop stirrup 20 which is illustrated as being integral with the frame extension 11. Mounted in proximity to the holding bar link 18 is a separating or biasing means 21, such as encapsulated prestressed rubber or steel springs, which when engaged by the holding bar link 18 provides a separating force between the holding bar link 18 and the lifting bar link 10 and, thus, between the lifting bar 5 and the holding bar 6.

It should now be understood that retraction of actuator means 17 causes the lifting bar link 10 to move generally upwardly in a vertical arc and, thus, causes the distal end of the lifting bar link 10 to rotate upwardly in a counterclockwise direction around pivot pin 8. As the lifting bar link 10 so rotates, horizontal lifitng bar 5 is moved upwardly into secure engagement with the downwardly concave lifting hook 3. As the lifting bar 5 continues to move upwardly, the service module is lifted at its rear end as described hereinabove and is drawn toward the service vehicle. Before the toggle linkage moves to lock in the toggle mode shown in FIG. 5, holding bar 6 makes contact with attachment means 2 and is brought into secure engagement with holding hook 4 as the service module C is lifted upwardly. With holding bar 6 securely engaged with holding hook 4, further movment of the toggle linkage toward the locking toggle mode tends to raise the holding bar link 18. This upward movement of holding bar link 18 causes compression of the separating means 21 which is engaged thereby. Compression of the separating means 21 creates a scissor-like separating force between the lifting bar link 10 and the holding bar link 18 and, thus, between the lifting bar 5 and the holding bar 6. As shown in FIG. 5, this separating force not only ensures that lifting bar 5 and holding bar 6 are securely and rigidly engaged with lifting hook 3 and holding hook 4, respectively, but also operates to ensure that the toggle linkage is rigidly locked in the toggle mode shown in FIG. 5. That is, there exists a cooperative relationship between the separating means 21 and the toggle linkage which securely locks the service module to the mining service vehicle independent of the influence of any hydraulic cylinder or system. The toggle linkage remains locked in the toggle mode until the vehicle operator reactivates the actuating means to lower the lifting bar 5 and, thus, to affirmatively move the toggle linkage from the toggle mode. While the toggle linkage is locked in the toggle mode, any pivot pins that may be loose or worn are solidly seated.

In order to provide the operator of the service vehicle with a target for proper orientation when approaching the service module C, a target tab 22 is mounted integrally on the service module C. From the position of the target tab 22, the operator can judge the relative position of the pivot pin 16 and thus of the linkage assembly with respect to the attachment means 2. If, when first contact between the lifting bar 5 and the attachment means 2 is made, the service module C is askew, the operator merely utilizes the service vehicle B to push the service module C slightly ahead until he senses that contact has been made at both ends of the lifting bar 5. When this proper orientation has been achieved, the locking mechanism can be activated to lift and lock the service module C to the service vehicle B. It is noted that in the illustrated embodiment the upper curved contour of the C-shaped attachment means 2 is an arc about the pivot center of lifting bar link 10. This configuration facilitates proper engagement between the lifting bar 5 and the lifting hook 3 when the locking mechanism is activated while the service vehicle is in a standing position.

It is also noted that the relative position of the lifting and holding bars 5 and 6 and of the attachment means 2 defines the position of the service module C with respect to the service vehicle B to provide traveling clearances between the module C and the ground. This relative position can be changed depending on the contour of the attachment means 2 and/or the location of the lifting and holding bars 5 and 6.

It is further noted that, as shown in FIG. 6, when the service module C is locked to the service vehicle B, the center of gravity of the service module is relatively close to the front axle of the service vehicle. Thus, the locking mechanism of the present invention reduces the normal distance from the center line of the front axle to the center of gravity of the load.

Thus, in summary, the present invention provides an automatic locking mechanism which is part of a standardized mining service vehicle and can be used to attach an unlimited variety of service modules to the vehicle. The locking mechanism can pick up a service module lying askew in front of the mining vehicle without the necessity of a conventional loader boom and tilt cylinders for aligning the mechanism with the module. The locking mechanism rigidly secures the module to the vehicle even in the event of hydraulic failure and even though there may be loose or worn pins in the linkage assembly. Thus, destructive impacts on the module, the vehicle and the locking mechanism are eliminated when the vehicle bounces over often-encountered rough terrain. Further, the locking mechanism makes it possible to pick up or drop off a module without manual attention. The vehicle operator can perform these tasks from the vehicle operating station. The locking mechanism is also designed to allow the service module to be carried close to the front axle of the service vehicle. This allows the service vehicle to handle heavier modules than can be handled by the same vehicle equipped with a conventional loader boom and hitching assembly.

I claim:

1. A quick-coupling locking mechanism for attaching a service module to a mining service vehicle or the like, said service module having secured thereto attachment means formed to define a lifting hook at its top and a holding hook at its bottom, comprising:

a. a linkage assembly secured to said service vehicle, said linkage assembly having a lifting bar link having one end pivotally mounted to the frame of said vehicle and a distal end having a horizontally extending lifting bar fixed thereto, and a holding bar link having one end pivotally mounted to the frame of said vehicle and a distal end having a horizontally extending holding bar fixed thereto;

b. selectively extensible reciprocative actuator means connected to said lifting bar link to forceably move said lifting bar link to pivot said link in a vertical arc such that said lifting bar is moved into engagement with said lifting hook to lift said service module at its rear end, to draw said module toward said service vehicle and to lift said service module to the fixed carry position, such that said holding hook is brought into engagement with said holding bar;

c. separating means affixed for engagement between said holding bar link and said separating link to provide a separating force between said lifting bar and said holding bar to ensure that said lifting bar and said holding bar are securely engaged with said lifting hook and said holding hook, respectively; and d. lockable toggle linkage connected at one end to said vehicle and at its other end to said lifting bar link such that said separating means operates to lock said toggle linkage so that said lifting bar and said holding bar are held in secure engagement with said lifting hook and said holding hook, respectively, independent of the influence of any hydraulic system.

2. A locking mechanism according to claim 1 wherein said attachment means comprises two C-shaped brackets, each of said brackets formed to define a lifting hook at its top and a holding hook at its bottom.

3. A locking mechanism according to claim 1 wherein said lockable toggle linkage comprises a toggle link having one end pivotally connected to the frame of said vehicle and its other end pivotally connected to one end of a connecting link, said connecting link having its other end pivotally connected to said lifting bar link.

4. A locking mechanism according to claims 1 or 3 wherein said separating means comprises compressible springs.

5. A locking mechanism according to claim 4 wherein said actuator means is a hydraulic cylinder.

* * * * *